United States Patent [19]

Haugen et al.

[11] Patent Number: 4,760,884

[45] Date of Patent: Aug. 2, 1988

[54] AIR CHAMBER ACTUATED DUAL TUBING RELEASE ASSEMBLY

[75] Inventors: David M. Haugen, Houston; Flint R. George, Katy; Kevin R. George, Columbus, all of Tex.

[73] Assignee: Halliburton Company, Duncan, Okla.

[21] Appl. No.: 908,833

[22] Filed: Sep. 16, 1986

[51] Int. Cl.[4] ..... E21B 23/00

[52] U.S. Cl. ..... 166/377; 166/163; 166/169; 166/237; 166/242; 285/83

[58] Field of Search ..... 166/377, 381, 242, 115, 166/117, 163, 165, 169, 162, 237, 383, 72; 285/83, 102, 306, 3

[56] References Cited

U.S. PATENT DOCUMENTS

| | | | |
|---|---|---|---|
| 3,047,072 | 7/1962 | Peters et al. | 166/164 |
| 3,997,006 | 12/1976 | Wetzel | 166/377 |
| 4,175,778 | 11/1979 | Nunez et al. | 285/3 |
| 4,190,107 | 2/1980 | Oden et al. | 285/306 X |
| 4,526,229 | 7/1985 | Dickerson | 166/120 |
| 4,526,233 | 7/1985 | Stout | 166/377 |
| 4,554,981 | 11/1985 | Davies | 166/55.1 |
| 4,570,714 | 2/1986 | Turner et al. | 166/377 X |
| 4,601,492 | 7/1986 | George | 285/3 |

*Primary Examiner*—Hoang C. Dang

*Attorney, Agent, or Firm*—James R. Duzan; E. Harrison Gilbert, III

[57] ABSTRACT

An apparatus and method of operation for the release of concentric tubing strings used in well operations. In the preferred embodiment, the apparatus includes a tubing release assembly and an air chamber assembly as an actuating tool. The tubing release assembly comprises a housing, release sleeve, adjustment nut, pull tube mandrel, pull tube adapter, pull tube latch and retainer ring. The air chamber assembly as an actuating tool comprises a lower end plug, a housing, a housing retainer, seal element assembly, upper and lower shear pin retainers, upper element cone, release ring, setting mandrel, upper end plug, retrieving mandrel, and match drill assembly. Alternately, the tubing release assembly may be actuated by a ball and increased fluid pressure level within the interior of the tubing release assembly.

12 Claims, 4 Drawing Sheets

AIR CHAMBER ACTUATED DUAL TUBING RELEASE ASSEMBLY

BACKGROUND OF THE INVENTION

The present invention relates to a dual tubing release apparatus and actuating apparatus therefor for use in well operations. More specifically, the present invention relates to an improved simultaneous concentric dual tubing release apparatus such as those described in U.S. patent application Ser. No. 773,773, filed on Sept. 5, 1985 now U.S. Pat. No. 4,655,298.

The well completion apparatus described in the above-identified application includes an apparatus for the simultaneous decoupling of concentric tubing strings through the use of a shifting tool run on a wireline or slickline in the well.

One of the decoupling apparatus includes a movable sleeve positioned between the first and second tubing strings adjacent the couplings for releasing the lower sections thereof. As the movable sleeve is slid by the shifting tool run on a wireline or slickline within a chamber formed between the tubing strings, collet fingers on the detachable couplings are released allowing the lower tubing sections to fall to the bottom of the well with the perforating gun.

In another embodiment, the movable sleeve includes a plurality of lugs which extend through the second tubing string towards the center of the tubing. These lugs can be engaged by a positioning tool lowered on a wireline or slickline into the well. The wireline or slickline can then be raised or lowered causing the sleeve to shift and detach the tubing.

SUMMARY OF THE INVENTION

The present invention is directed to an apparatus and method of operation for the release of concentric tubing strings used in well operations.

The apparatus includes a tubing release assembly and an air chamber assembly as an actuating tool.

The tubing release assembly comprises a housing, release sleeve, adjustment nut, pull tube mandrel, pull tube adapter, pull tube latch and retainer ring.

The air chamber assembly as an actuating tool comprises a lower end plug, a housing, a housing retainer, seal element assembly, upper and lower shear pin retainers, upper element cone, release ring, setting mandrel, upper end plug, retrieving mandrel, and match drill assembly.

In an alternative embodiment, the tubing release assembly comprises a housing, release sleeve, adjustment nut, pull tube mandrel, pull tube adapter having a ball seat therein and pull tube latch. The alternative embodiment of the tubing release assembly is actuated by a ball being pressured against the ball seat of the pull tube adapter.

Additional features and advantages of the invention will become more fully apparent from the following detailed description and claims taken in conjunction with the attached drawings.

DETAILED DESCRIPTION OF THE INVENTION

Figure 1A:
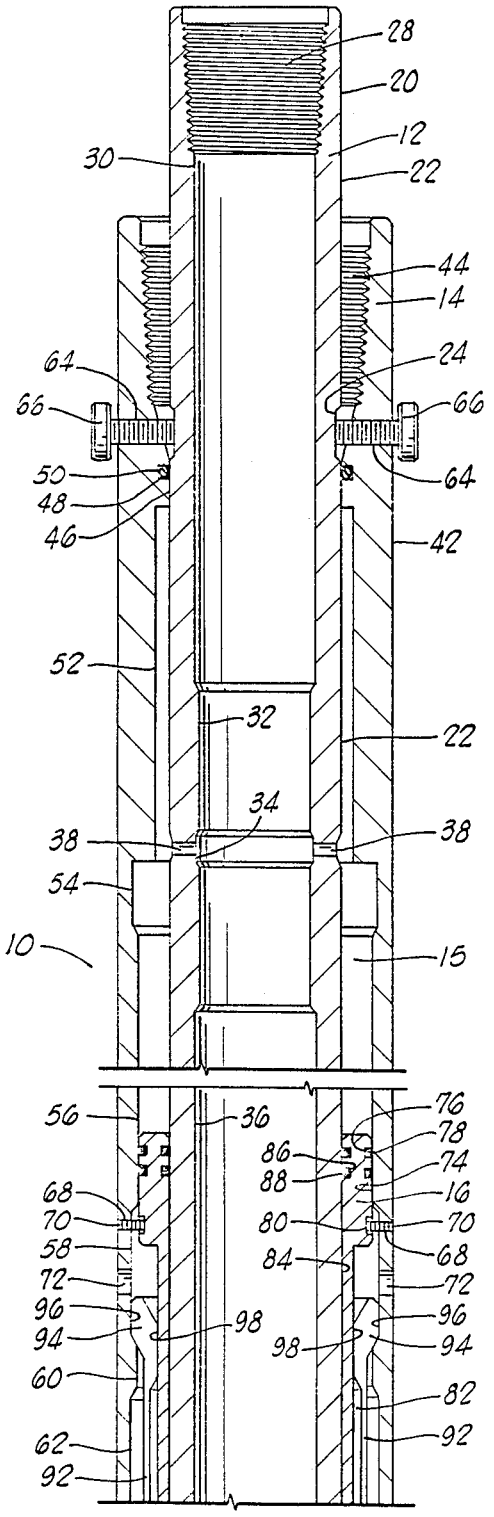
FIGS. 1A and 1B are cross-sectional views of the tubing release assembly of the present invention.
Figure 1B:
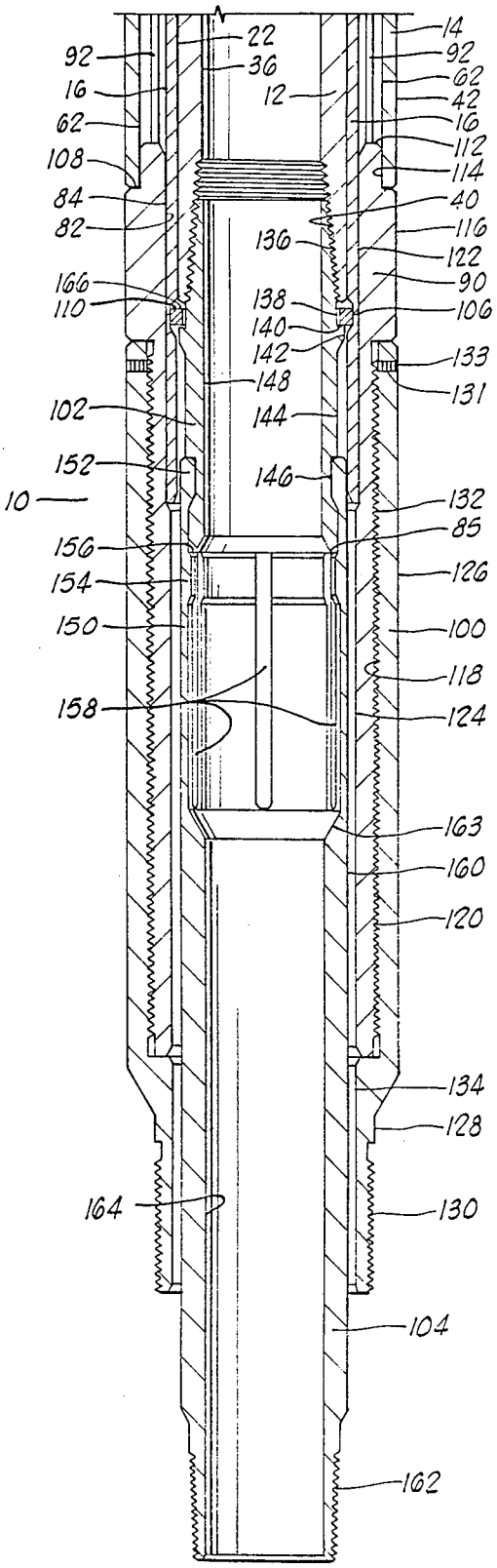

Referring to FIGS. 1A and 1B, the tubing release assembly 10 of the present invention is shown in its preferred embodiment.

Referring, more specifically, to FIG. 1A, a portion of the pull tube mandrel 12, upper housing 14, release sleeve 16, and lower housing 90 are shown.

As shown in FIG. 1A, the portion of the pull tube mandrel 12 comprises an elongated annular cylindrical member having, on the exterior thereof, first cylindrical surface 20, second cylindrical surface 22 having, in turn, first annular recess 24 therein and second annular recess 26 therein and, on the interior thereof, first threaded bore 28, first cylindrical bore 30, and second cylindrical bore 32 having, in turn, annular recess 34 therein, and third cylindrical bore 36. The portion of the pull tube mandrel 12 further includes a plurality of apertures 38 which allow fluid communication between the exterior of the mandrel 12 to the interior thereof.

The portion of the upper housing 14 comprises an elongated annular cylindrical member having, on the exterior thereof, cylindrical surface 42 and, on the interior thereof, threaded bore 44, first cylindrical bore 46 having, in turn, annular recess 48 therein containing annular elastomeric seal 50 which sealingly engages second cylindrical surface 22 of pull tube mandrel 12, second cylindrical bore 52, third cylindrical bore 54, fourth cylindrical bore 56, fifth cylindrical bore 58, sixth cylindrical bore 60 having a diameter smaller than bore 58 and seventh cylindrical bore 62 having a diameter greater than bore 60. The portion of the upper housing 14 shown further includes a plurality of first threaded apertures 64 threadedly receiving a plurality of threaded fasteners 66 therein, a plurality of second threaded apertures 68 receiving a plurality of threaded set screws 70 therein and a plurality of apertures 72 which allow fluid communication from the exterior of the upper housing 14 to the interior thereof.

The portion of the release sleeve 16 comprises an elongated annular cylindrical member having on the exterior thereof first cylindrical surface 74 having, in turn, annular recesses 76 containing annular elastomeric seals 78 therein and annular recess 80 and second cylindrical surface 82 and, on the interior thereof, cylindrical bore 84 having, in turn, first annular recesses 86 therein containing annular elastomeric seals 88 therein.

The portion of the lower housing 90 comprises a plurality of collet fingers 92 having enlarged heads 94 thereon having, in turn, exterior surfaces 96 which engage fifth cylindrical bore 58 of upper housing 14 and interior surfaces 98 which slidingly engage second cylindrical surface 82 of release sleeve 16.

Referring to FIG. 1B, the remaining portion of the tubing release assembly 10 is shown.

The remaining portion of the tubing release assembly 10 comprises a portion of pull tube mandrel 12, a portion of upper housing 14, a portion of release sleeve 16, a portion of lower housing 90, adjustment nut 100, pull tube adapter 102, pull tube latch 104, and retainer ring 106.

The portion of pull tube mandrel 12 comprises an elongated annular cylindrical member having, on the exterior thereof, a continuation of second cylindrical surface 22, and, on the interior thereof, a continuation of third cylindrical bore 36 and second threaded bore 40.

The portion of the upper housing 14 comprises an elongated annular cylindrical member having, on the exterior thereof, a continuation of cylindrical surface 42 and, on the interior thereof, a continuation of seventh cylindrical bore 62. The upper housing 14 further includes annular end surface 108.

The portion of the release sleeve 16 comprises an elongated annular member having, on the exterior thereof, a continuation of second cylindrical surface 82 and, on the interior thereof, a continuation of cylindrical bore 84 having a second annular recess 110 therein.

The portion of the lower housing 90 comprises an elongated annular cylindrical member having, connected to one end thereof, a plurality of collet fingers 92, on the exterior thereof, first cylindrical surface 114 which slidingly engages seventh cylindrical bore 62 of upper housing 14, second cylindrical surface 116, and third cylindrical surface 118, and, on the interior thereof, first cylindrical bore which slidingly mates with second cylindrical surface 82 of release sleeve 16 and second cylindrical bore 124.

The adjustment nut 100 comprises an elongated annular cylindrical member having, on the exterior thereof, first cylindrical surface 126, second cylindrical surface 128 and threaded surface 130 and, on the interior thereof, threaded bore 132 which releasably, threadedly engages threaded surface 120 of lower housing 90 and cylindrical bore 134. The adjustment nut 100 further includes a plurality of threaded apertures 131 which releasably, threadedly engage a plurality of set screws 133 installed therein which in turn, have one end thereof engaging third cylindrical surface 118 of lower housing 90.

The pull tube adapter 102 comprises an elongated annular cylindrical member having, on the exterior thereof, threaded surface 136 which releasably, threadedly engages second threaded bore 40 of pull tube mandrel 12, first cylindrical surface 138, annular shoulder 140, second cylindrical surface 142, and third cylindrical surface 144 having, in turn, annular recess 146 therein and, on the interior thereof, cylindrical bore 148.

The pull tube latch 104 comprises an elongated annular cylindrical member having, on one end thereof, a plurality of collet fingers 150 having, in turn, enlarged heads 152 thereon which releasably engage annular recess 146 in third cylindrical surface 144 of pull tube adapter 102 and enlarged interior projections 154 which abut the end 156 of pull tube adapter 102, the collet fingers 150 being separated from each other by a plurality of longitudinal slots 158 and, on the exterior thereof, cylindrical surface 160 and threaded surface 162, and, on the interior thereof, cylindrical bore 164.

As shown in FIG. 1B, when the tubing release assembly 10 is assembled, a resilient annular retainer ring 106 is installed resiliently engaging second annular recess 110 of cylindrical bore 84 of release sleeve 16 and abutting annular surface 140 of pull tube adapter 102 being retained thereon by the end 166 of pull tube mandrel 12.

Figure 2A:
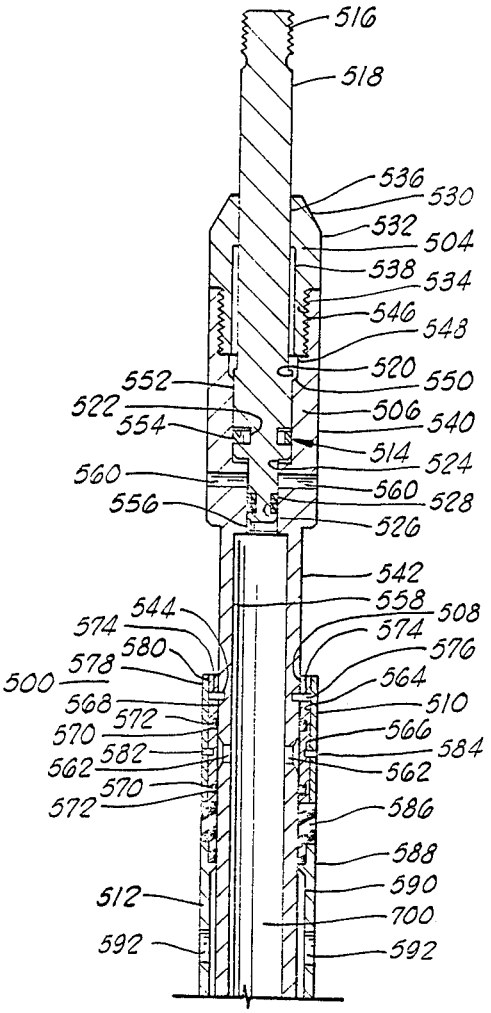
FIGS. 2A and 2B are cross-sectional views of the actuating tool.
Figure 2B:
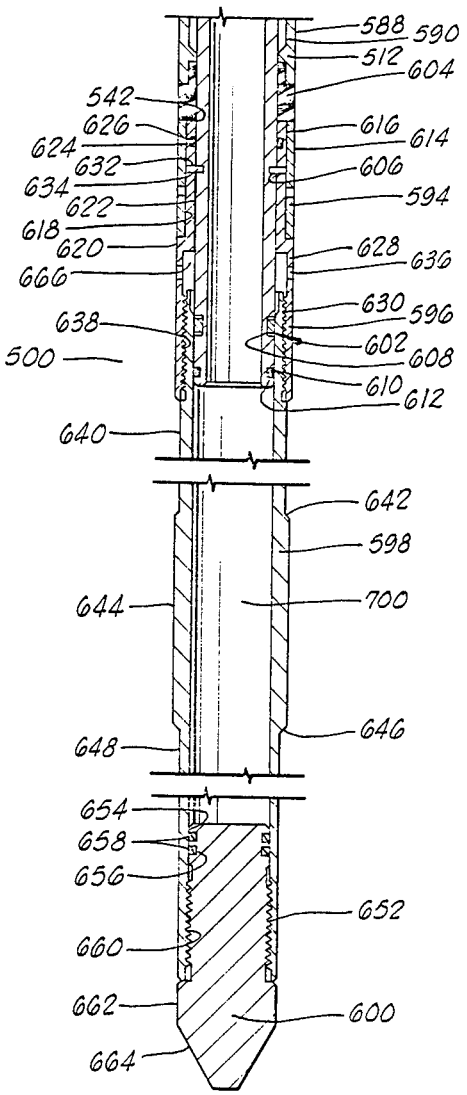

Referring to FIGS. 2A and 2B, the upper portion of the air chamber assembly 500 is shown in its preferred embodiment.

As shown in FIG. 2A, the upper portion of the air chamber assembly 500 includes retrieving mandrel 502, upper end plug 504, a portion of the setting mandrel 506, upper element cone 508, upper shear pin retainer 510, a portion of bonded seal element assembly 512, and release ring 514.

The retrieving mandrel 502 comprises an elongated cylindrical member having, on one end thereof, threaded surface 516 and on the exterior thereof, first cylindrical surface 518, second cylindrical surface 520 having, in turn, annular recess 522 therein, third cylindrical surface 524 having, in turn, annular recess 526 therein containing annular elastomeric seals 528.

The upper end of plug 504 comprises an elongated annular cylindrical member having, on the exterior thereof, frusto-conical surface 530, cylindrical surface 532, and threaded surface 534 and, on the interior thereof, first cylindrical bore 536 which slidingly engages first cylindrical surface 518 of retrieving mandrel 502 and second cylindrical bore 538.

The portion of the setting mandrel 506 shown comprises an elongated annular cylindrical member having, on the exterior thereof, first cylindrical surface and second cylindrical surface 542 having, in turn, an annular recess 544 therein and, on the interior thereof, threaded bore 546 which releasably, threadedly engages thread surface 534 of upper end plug 504, first cylindrical bore 548, frusto-conical bore 550, second cylindrical bore 552 having, in turn, annular recess 554 therein, third cylindrical bore 556 which slidingly, sealingly engages annular elastomeric seals 528 on retrieving mandrel 502 and fourth cylindrical bore 558. Also shown, included in setting mandrel 506 are a first plurality of apertures 560 which allow fluid communication between the first cylindrical surface 540 of the exterior of the mandrel 506 and third cylindrical bore 556 of the interior of mandrel 506 and a second plurality of apertures 562 which allow fluid communication between the second cylindrical surface 542 of the mandrel 506 and the fourth cylindrical bore 558 of the mandrel 506.

The upper element cone 508 comprises an annular cylindrical member having, on the exterior thereof, cylindrical surface 564 having, in turn, annular recess 566 therein and, on the interior thereof, 568 having, in turn, annular recess 570 therein containing annular elastomeric seals 572 which slidingly, sealingly engage second cylindrical surface 542 of setting mandrel 506. The upper element cone 508 further includes a plurality of apertures 574 having a plurality of shear pins 576 contained therein which, in turn, have a portion of each pin 576 retained within annular recess 544 of setting mandrel 506.

The upper shear pin retainer 510 comprises an annular cylindrical member having exterior surface 578, interior surface 580 and a plurality of apertures 582 therein having, in turn, a plurality of threaded pins 584 therein, each pin 584 having a portion thereof engaging annular recess 566 of upper element cone 508.

The portion of the bonded seal element assembly 512 comprises an elongated, annular cylindrical member having, on one end thereof, annular elastomeric member 586, on the exterior thereof, cylindrical surface 588, on the interior thereof, cylindrical bore 590 and a plurality of apertures 592 therethrough.

As further shown in FIG. 2A, the release ring 514 comprises an annular resilient member which is retained on retrieving mandrel 502 in annular recess 522 therein and resiliently engages annular recess 554 in setting mandrel 506.

Referring to FIG. 2B, the remaining portion of the air chamber assembly 500 comprises a portion of bonded seal element assembly 512, a portion of setting mandrel 506, lower shear pin retainer 594, match drill assembly 596, housing 598, lower end plug 600 and housing retainer 602.

The portion of the bonded seal element assembly 512 comprises an elongated, annular cylindrical member having cylindrical surface 588, cylindrical bore 590 and annular elastomeric member 604 bonded to the other end thereof.

The portion of setting mandrel 506 comprises an elongated annular cylindrical member having, on the exterior thereof, a continuation of second cylindrical surface 542 having, in turn, second annular recess 606 therein, third annular recess 608 therein and fourth annular recess 610 therein containing annular elastomeric seal 612 and, on the interior thereof, a continuation of fourth cylindrical bore 558.

The lower shear pin retainer 594 comprises an annular cylindrical member having exterior cylindrical surface 614 and interior cylindrical bore 616.

The match drill assembly 596 comprises an elongated annular cylindrical member having, on the exterior thereof, first cylindrical surface 618 and second cylindrical surface 620 and, on the interior thereof, first cylindrical bore 622 having, in turn, annular recess 624 therein containing annular elastomeric seal 626 which slidingly, sealingly engages second cylindrical surface 542 of setting mandrel 506, second cylindrical bore 628, and threaded bore 630. The match drill assembly further includes a first plurality of apertures 632 having, in turn, a plurality of shear pins 634 therein, each pin 634 having a portion thereof engaging third annular recess 606 in setting mandrel 506 and a second plurality of apertures 636 which allow fluid communication from the exterior of the match drill assembly 596 to the interior thereof.

The housing 598 comprises an elongated annular cylindrical member having, on the exterior thereof, threaded surface 638 which threadedly engages threaded bore 630 of match drill assembly 596, first cylindrical surface 640, first annular frusto-conical surface 642, second cylindrical surface 644, second annular frusto-conical surface 646, and third cylindrical bore 650 and threaded bore 652.

The lower end plug 600 comprises an elongated cylindrical member having first cylindrical surface 654 having, in turn, annular recesses 656 therein containing annular elastomeric seals 658 which sealingly engage cylindrical bore 650 of housing 598, threaded surface 660 which releasably, threadedly engages threaded bore 652 of housing 598, second cylindrical surface 662, and frusto-conical annular surface 664

Also shown in FIG. 2B is housing retainer 602 which comprises an annular resilient member retained on setting mandrel 508 in annular recess 608 therein.

Figure 4A:
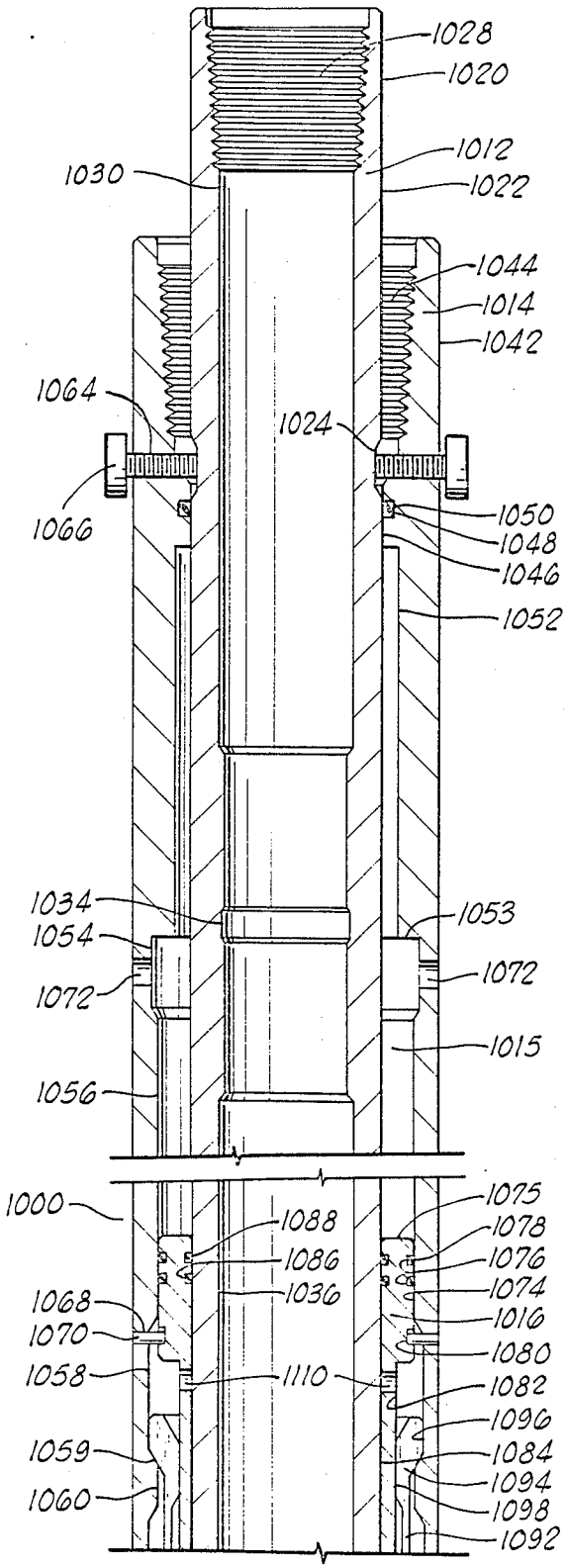
FIGS. 4A and 4B are cross-sectional views of an alternative embodiment of the tubing release assembly of the present invention.
Figure 4B:
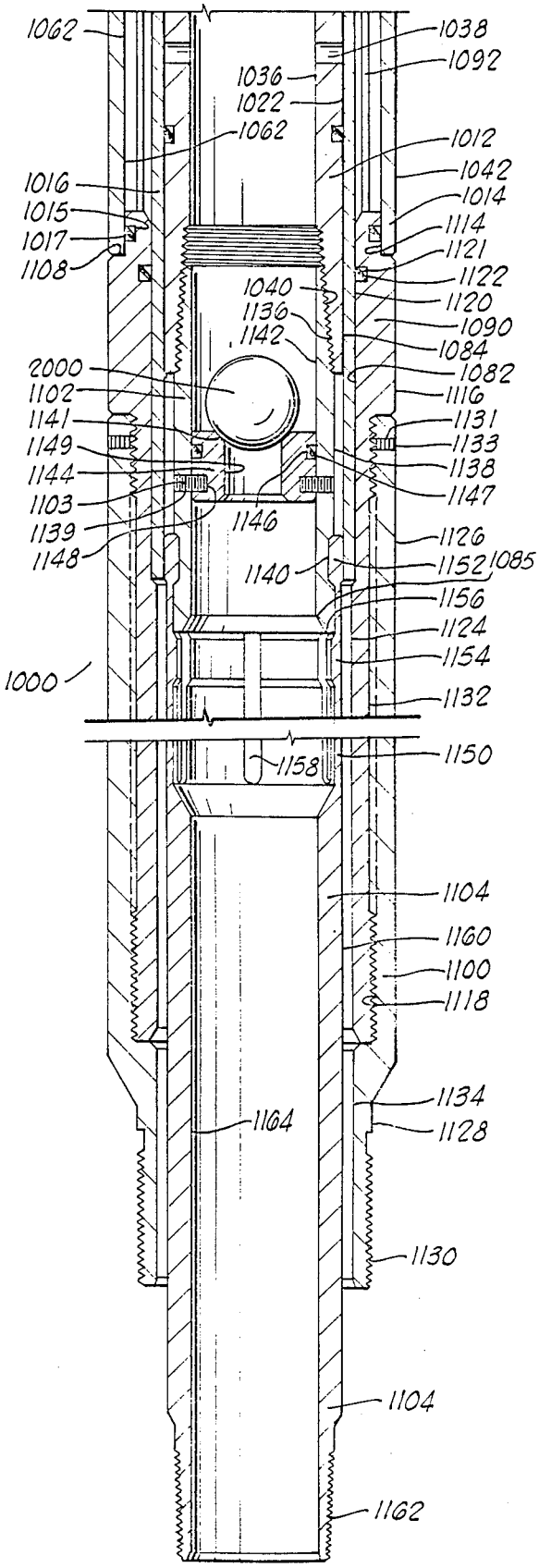

Referring to FIGS. 4A and 4B, an alternative emobidment assembly 1000 of the present invention is shown.

Referring, more specifically, to FIG. 4A, a portion of the pull tube mandrel 1012, upper housing 1014, release sleeve 1016, and lower housing 1090 are shown.

As shown in FIG. 4A, the portion of the pull tube mandrel 1012 comprises an elongated annular cylindrical member having, on the exterior thereof, first cylindrical surface 1020, second cylindrical surface 1022 having, in turn, first annular recess 1024 therein and, on the in interior thereof, first threaded bore 1028, first cylindrical bore 1030, and second cylindrical bore 1032 having, in turn, annular recess 1034 therein, and third cylindrical bore 1036. The portion of the pull tube mandrel 1012 further includes a plurality of apertures 1038 which allow fluid communication between the exterior of the mandrel 12 to the interior thereof.

The portion of the upper housing 1014 comprises an elongated annular cylindrical member having, on the exterior thereof, cylindrical surface 1042 and, on the interior thereof, threaded bore 1044, first cylindrical bore 1046 having, in turn, annular recess 1048 therein containing annular elastomeric seal 1050 which sealingly engages second cylindrical surface 1022 of pull tube mandrel 1012, second cylindrical bore 1052, third cylindrical bore 1054, fourth cylindrical bore 1056, fifth cylindrical bore 1058, sixth cylindrical bore 1060 having a diameter smaller than bore 1058 and seventh cylindrical bore 1062 having a diameter greater than bore 1060. The portion of the upper housing 1014 shown further includes a plurality of first threaded apertures 1064 threadedly receiving a plurality of threaded fasteners 1066 therein, a plurality of second threaded apertures 1068 receiving a plurality of threaded set screws 1070 therein and a plurality of apertures 1072 which allow fluid communication from the exterior of the upper housing 1014 to the interior thereof.

The portion of the release sleeve 1016 comprises an elongated annular cylindrical member having on the exterior thereof first cylindrical surface 1074 having, in turn, annular recesses 1076 containing annular elastomeric seals 1078 therein and annular recess 1080 and second cylindrical surface 1082 and, on the interior thereof, cylindrical bore 1084 having, in turn, first annular recesses 1086 therein containing annular elastomeric seals 1088 therein. The release sleeve 1016 further includes a plurality of apertures 1110 therethrough to allow fluid communication from the interior to the exterior thereof.

The portion of the lower housing 1090 comprises a plurality of collet fingers 1092 having enlarged heads 1094 thereon having, in turn, exterior surfaces 1096 which engage fifth cylindrical bore 1058 of upper housing 1014 and interior surfaces 1098 which slidingly engage second cylindrical surface 1082 of release sleeve 1016.

Referring to FIG. 4B, the remaining portion of the tubing release assembly 1000 is shown.

The remaining portion of the tubing release assembly 1000 comprises a portion of pull tube mandrel 1012, a portion of upper housing 1014, a portion of release sleeve 1016, a portion of lower housing 1090, adjustment nut 1100, pull tube adapter 1102, and pull tube latch 1104.

The portion of pull tube mandrel 1012 comprises an elongated annular cylindrical member having, on the exterior thereof, a continuation of second cylindrical surface 1022, and, on the interior thereof, a continuation of third cylindrical bore 1036 and second threaded bore 1040.

The portion of the upper housing 1014 comprises an elongated annular cylindrical member having, on the exterior thereof, a continuation of cylindrical surface 1042 and, on the interior thereof, a continuation of seventh cylindrical bore 1062. The upper housing 1014 further includes annular end surface 1108.

The portion of the release sleeve 1016 comprises an elongated annular member having, on the exterior thereof, a continuation of second cylindrical surface 1082 and, on the interior thereof, a continuation of cylindrical bore 1084.

The portion of the lower housing 1090 comprises an elongated annular cylindrical member having, connected to one end thereof, a plurality of collet fingers 1092, on the exterior thereof, first cylindrical surface 1114 which slidingly, sealingly engages seventh cylindrical bore 1062 of upper housing 1014 and has annular recess 1015 containing annular elastomeric seal 1011 therein, second cylindrical surface 1116, and third cylindrical surface 1118, and, on the interior thereof, first cylindrical bore 1120 which slidingly, sealingly mates with second cylindrical surface 1082 of release sleeve 1016 and has annular recess 1121 containing annular elastomeric seal 1122. therein, and second cylindrical bore 1124.

The adjustment nut 1100 comprises an elongated annular cylindrical member having, on the exterior thereof, first cylindrical surface 1126, second cylindrical surface 1128 and threaded surface 1130 and, on the interior thereof, threaded bore 1132 which releasably, threadedly engages threaded surface 1118 of lower housing 1090 and cylindrical bore 1134. The adjustment nut 1100 further includes a plurality of threaded apertures 1131 which releasably, threadedly engage a plurality of set screws 1133 installed therein which in turn, have one end thereof engaging third cylindrical surface 1118 of lower housing 1090.

The pull tube adapter 1102 comprises an elongated annular cylindrical member having, on the exterior thereof, threaded surface 1136 which releasably, threadedly engages second threaded bore 1040 of pull tube mandrel 1012, cylindrical surface 1138, having, in turn, annular recess 1140 therein and, on the interior thereof, cylindrical bore 1142.

The pull tube adapter 1102 further includes annular cylindrical ball seat 1144 having, on the exterior thereof, cylindrical surface 1145 having, in turn, annular recess 1146 containing annular elastomeric seal 1147 therein sealingly engaging bore 1142 of the adapter 1102 and annular recess 1148 and, on the interior thereof, annular frusto-conical ball seal 1141 and bore 1149 therethrough. The annular cylindrical ball seal 1144 is releasably retained within the bore 1142 of pull tube adapter 1102 by a plurality of shear pins 1103 which, in turn, are releasably retained within threaded apertures 1139 of adapter 1102 and have a portion thereof engaging annular recess 1148 of seal 1144.

The pull tube latch 1104 comprises an elongated annular cylindrical member having, on one end thereof, a plurality of collet fingers 1150 having, in turn, enlarged heads 1152 thereon which releasably engage annular recess 1140 in the cylindrical surface 1138 of pull tube adapter 1102 and enlarged interior projections 1154 which abut the end 1156 of pull tube adapter 1102, the collet fingers 1150 being separated from each other by a plurality of longitudinal slots 1158 and, on the exterior thereof, cylindrical surface 1160 and threaded surface 1162, and, on the interior thereof, cylindrical bore 1164.

OPERATION OF THE TUBING RELEASE ASSEMBLY

Figure 3A:
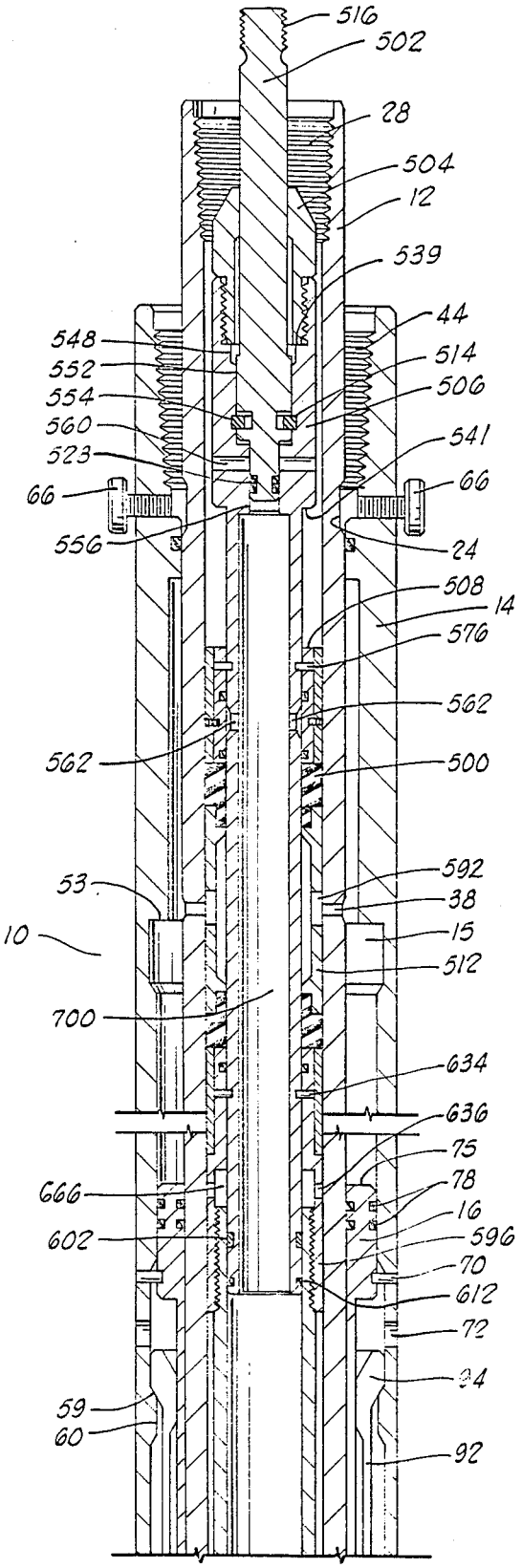
FIGS. 3A and 3B are cross-sectional views of the tubing release assembly and air chamber assembly received therein.
Figure 3B:
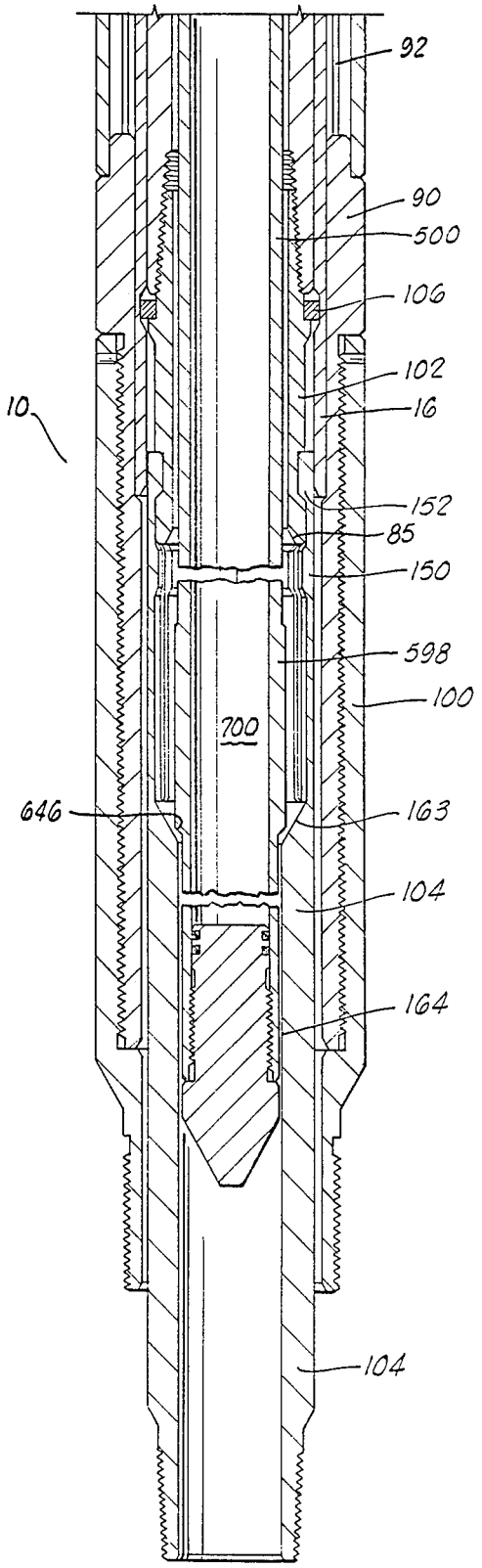

Referring to FIGS. 3A and 3B, the operation of the tubing release assembly 10 of the present invention by the air chamber assembly 500 will be described.

When in use, the tubing release assembly 10 has tubing filled with fluid connected to first threaded bore 28 of pull tube mandrel 12 and threaded bore 44 of upper housing 14 and threaded fasteners 66 are disengaged from annular recess 24 of pull tube mandrel 12.

The air chamber assembly 500 is lowered into the tubing release assembly 10 by the air chamber assembly 500 having a slickline, or the like, attached to threaded surface 516 of retrieving mandrel 502.

The air chamber assembly 500 is lowered into the tubing release assembly 10 until second annular frusto-conical surface 646 of housing 598 of air chamber assembly 500 abuts annular frusto-conical bore 163 of pull tube latch 104 of the tubing release assembly 10 (see FIG. 3B).

When this occurs, apertures 592 in bonded seal assembly 512 of air chamber assembly 500 are aligned with apertures 38 of pull tube mandrel 12 of tubing release assembly 512 and annular elastomeric members 586 and 604 are positioned on either side of apertures 592.

Internal chamber 700 of the air chamber assembly 500 is at atmospheric pressure when the air chamber assembly 500 is landed into tubing release assembly 10. Before the actuation of air chamber assembly 500, apertures 562 in setting mandrel 506 are sealingly covered by upper element cone 508 to prevent fluid flow through apertures 562 with the shear pins 576 retaining the upper element cone 508 stationary on setting mandrel 506.

As hydrostatic fluid pressure of the fluid in the tubing connected to the tubing release assembly 10 is trying to shear shear pins 634 in shear pin retainer 594, the shear-pins 634 must always have sufficient strength to prevent the hydrostatic fluid pressure of the fluid in the tubing from causing the pins to shear.

To actuate the air chamber assembly 500 after it is received in tubing release assembly 10, the application of a downhole force on the retrieving mandrel 502 of air chamber assembly 500 is made. When this force is applied, shear pins 576 and 634 are sheared thereby allowing setting mandrel 506 to move downwardly with respect to upper element cone 508, bonded seal assembly 512, shear pin retainer 594 and housing 598 until annular shoulder 541 of setting mandrel 506 abuts the upper end of upper element cone 508 and shear pin retainer 510 thereby aligning the apertures 562 in the setting mandrel 506 with the apertures 592 in bonded seal assembly 512 of chamber assembly 500 and apertures 38 of pull tube mandrel 12 of tubing release assembly 10.

With the downward movement of the setting mandrel 506 abuttingly engaging upper end of upper element cone 508 and shear pin retainer 510 the annular elastomeric members 586 and 604 firmly, sealingly engage second cylindrical bore 32 of pull tube mandrel 12 with the alignment of apertures 562, 592 and 38 respectively, the annular chamber 15 of tubing release assembly 10 is vented to, or placed in communication with, chamber 700 of air chamber assembly 500.

With the venting of annular chamber 15 of the tubing release assembly 10 with, or in fluid communication with, the chamber 700 of the air chamber assembly 500 since the chamber 700 is initially at atmospheric pressure and the fluid in annular chamber 15 is at the hydrostatic fluid pressure in the tubing which has been trapped in annular chamber 15 when the air chamber assembly 500 is lowered into tubing release assembly 10 by pull tube mandrel 12 of assembly 10 sealingly engaging bonded seal assembly 512 of air chamber assembly 500, the fluid in the tubing flows through apertures 38 in pull tube mandrel 12, from annular chamber 15 and flows into chamber 700 thereby causing a pressure differential across release sleeve 16 since release sleeve 16 has hydrostatic fluid pressure acting on one side thereof through apertures 72 in upper housing 14. When this pressure differential across release sleeve 16 is sufficient to cause shearing of shear pins 70, the release sleeve 16 moves upwardly through annular chamber 15 into the upper enlarged portion thereof with the end surface 75 of release sleeve 16 possibly abutting annular surface 53 of upper housing 14 and essentially atmospheric pressure acting on the outer side thereof by the venting of trapped hydrostatic fluid pressure in annular chamber 15 to chamber 700 of air chamber assembly 500. When the release sleeve 16 moves upwardly, the retainer ring 106 is resiliently compressed inwardly until the release sleeve 16 has moved thereby when it springs outwardly past end surface 85 of the sleeve 16 to prevent any downward movement of the sleeve 16 in the tubing release assembly 10.

When the release sleeve 16 no longer has a portion thereof abutting enlarged heads 152 of collet fingers 150 of pull tube latch 104, the collet fingers 150 are cammed outwardly to disengage annular recess 146 of the pull tube adapter 102 by the weight of the tubing string attached to pull tube latch 104 thereby releasing the latch 104 from adapter 102.

Similarly, since the end 85 of release sleeve 16 moves upwardly past enlarged heads 94 of collet fingers 92 of lower housing 90, due to the weight of the tubing string attached to adjustment nut 100, the enlarged heads 94 disengage annular frusto-conical surface 59 and move past sixth cylindrical bore 60 of upper housing 14 thereby releasing the upper housing 14 from lower housing 90.

Also, when release sleeve 16 moves upwardly through annular chamber 15 and abuts end surface 53 of upper housing 14, since the annular elastomeric seals 78 of sleeve 16 no longer sealingly engage fourth cylindrical bore 56 of upper housing 14, fluid is free to bypass through apertures 72 in upper housing 14 and around the release sleeve 16 thereby relieving the pressure differential around sleeve 16 thereby acting as an auto-release of the air chamber assembly 500.

Alternately, the air chamber assembly 500 may be removed from the tubing release assembly 10 an upward jarring force is applied through the slickline, or the like, connected to retrieving mandrel 502 of the air chamber assembly 500. The jarring force causes release ring 514 to resiliently compress out of engagement with annular recess 554 of setting mandrel 506 thereby allowing retrieving mandrel 502 to move upwardly in setting mandrel 506 until release ring 514 springs outwardly from second cylindrical bore 552, while still engaging annular recess 552 of retrieving mandrel 502, into first cylindrical bore 548 and abuts end surface 539 of upper end plug 504. At this time, annular elastomeric seals 528 no longer sealingly engage third cylindrical bore 556 thereby allowing fluid communication through apertures 560 in setting mandrel 506, through third cylindrical bore 556 and into chamber 700. This upward movement of retrieving mandrel 502 also causes upward movement of setting mandrel 506 until housing retainer 602 springs outwardly into annular cavity 666 abutting the upper wall thereof thereby allowing fluid flow past the end of setting mandrel 506, past annular elastomeric seal 612 and through apertures 636 in match drill assembly 596 thereby allowing fluid flow to bypass annular elastomeric members 586 and 604 of bond seal element assembly 512.

Referring to FIGS. 4A and 4B, the operation of the tubing release assembly 1000 of the present invention by the ball 2000 and increased fluid pressure actuating thereon will be described.

When in use, the tubing release assembly 1000 has tubing filled with fluid connected to first threaded bore 1028 of pull tube mandrel 1012 and threaded bore 1044 of upper housing 1014 and threaded fasteners 1066 are disengaged from annular recess 1024 of pull tube mandrel 1012.

The ball 2000 is inserted and falls into the tubing release assembly 1000 until it seats on ball seat 1144.

After the ball 2000 lands on frusto-conical annular seat 1141 of ball seat 1144, the fluid pressure in the tubing is increased and act through apertures 1038 in pull tube mandrel 1012 and apertures 1110 of release sleeve 1016 thereby causing a pressure differential across release sleeve 1016 since release sleeve 1016 has hydrostatic fluid pressure acting on one side thereof through apertures 1072 in upper housing 1014. When this pressure differential across release sleeve 1016 is sufficient to cause shearing of shear pins 1070, the release sleeve 1016 moves upwardly through annular chamber 1015 into the upper enlarged portion thereof with the end surface 1075 of release sleeve 1016 possibly abutting annular surface 1053 of upper housing 1014.

When the release sleeve 1016 no longer has a portion thereof abutting enlarged heads 1152 of collet fingers 1150 of pull tube latch 1104, the collet fingers 1150 are cammed outwardly to disengage annular recess 1140 of the pull tube adapter 1102 by the weight of the tubing string attached to pull tube latch 1104 thereby releasing the latch 1104 from adapter 1102.

Similarly, since the end 1085 of release sleeve 1016 moves upwardly past enlarged heads 1094 of collet fingers 1092 of lower housing 1090, due to the weight of the tubing string attached to adjustment nut 1100, the enlarged heads 1094 disengage annular frusto-conical surface 1059 and move past sixth cylindrical bore 1060 of upper housing 1014 thereby releasing the upper housing 1014 from lower housing 1090.

Also, when release sleeve 1016 moves upwardly through annular chamber 1015 and abuts end surface 1053 of upper housing 1014, since the annular elastomeric seals 1078 of sleeve 1016 no longer sealingly engage fourth cylindrical bore 1056 of upper housing 1014, fluid is free to bypass through apertures 1072 in upper housing 1014 and around the release sleeve 1016 thereby relieving the pressure differential around sleeve 1016.

While the invention has been illustrated with respect to the present preferred embodiments, it will be appreciated that numerous modifications and changes could be made without departing from the spirit or essential characteristics of the invention. For example, the chamber 700 of the air chamber assembly 500 may be at any desired fluid pressure level.

Other modifications and changes to the invention will be apparent to those skilled in the art. Accordingly, all changes or modifications which come within the meaning and range of equivalency of the claims are to be embraced within their scope.

Having thus described our invention, we claim:

1. An apparatus to releasably connect and release when actuated a portion of conduit string to and from another portion thereof, said conduit string being installed in a well bore, said conduit string and said well bore having fluid therein, said apparatus comprising:

a tubing release assembly means being installed in said conduit string connecting said portion of said conduit string to said another portion thereof and capable of being actuated to release said one portion of said conduit string from said another portion thereof upon the communication of a fluid pressure to the tubing release assembly means which is less than the hydrostatic pressure of either of said fluid in said conduit string or said well bore at the location in said conduit string at which the tubing release assembly means is installed in said conduit string, the tubing release assembly means including:

a first member connected to said portion of said conduit string;

a second member connected to said another portion of said conduit string, said second member having a portion thereof releasably secured to a portion of said first member; and a release member which is movable from a first position with respect to said first member and said second member having a portion thereof engaging said first member and said second member to cause said first member and said second member to be releasably secured to each other to a second position with respect to said first member and said second member having a portion thereof remaining in engagement with said portion of said first member and disengaging from said portion of said second member upon the communication of said fluid pressure to said tubing release assembly means to allow the release of said first member from said second member by the movement of said release member from said first position to said second position whereby said second member releases from engagement from said first member; and an independent actuating tool means for use with said tubing release assembly means, said actuating tool means when actuated and in communication with said release assembly means causing said fluid pressure to be communicated to the tubing release asssembly means which is less than either the hydrostatic fluid pressure of said fluid in said conduit string or said well bore at the location in said conduit string at which said tubing release assembly means is installed in said conduit string, said actuating tool means adapted to be conveyed through said portion of said conduit string, said actuating tool means including:

a member having a chamber therein capable of retaining a desired level of fluid pressure therein; and means to communicate said desired level of fluid pressure in said chamber of said member to said tubing release assembly means to cause the actuation thereof when said actuating tool means is releasably engaged therewith.

2. The apparatus of claim 1 wherein said conduit string comprises a dual conduit string.

3. The apparatus of claim 1 wherein said tubing release assembly means includes:

an upper housing comprising a portion of said first member connected to said portion of said conduit string, said upper housing having a portion thereof connected to said conduit string;

an adjustment nut comprising a portion of said second member connected to said another portion of said conduit string, said adjustment nut having a portion thereof connected to said another portion of said conduit string;

a lower housing comprising another portion of said second member connected to said another portion of said conduit string, said lower housing having said adjustment nut adjustably secured thereon and having a portion thereof releasably engaging a portion of said upper housing; and a release sleeve slidable within a portion of said upper housing retaining a portion of said upper housing connected to a portion of said lower housing when said release sleeve is in a first position within said upper housing.

4. The apparatus of claim 2 wherein said tubing release assembly means comprising:

an upper housing comprising a portion of said first member connected to said portion of said conduit string wherein said conduit string comprises dual conduit strings, said upper housing having a portion thereof connected to a portion of one conduit string of said dual conduit strings;

an adjustment nut comprising a portion of said second member connected to said another portion of said conduit string wherein said conduit string comprises dual conduit strings, said adjustment nut having a portion thereof connected to another portion of said one conduit string of said dual conduit strings;

a lower housing comprising another portion of said second member connected to said another portion of said conduit string wherein said conduit string comprises dual conduit strings, said lower housing having said adjustment nut adjustable secured thereon and having a portion thereof releasably engaging a portion of said upper housing;

a pull tube mandrel having a portion thereof connected to a portion of the other string of said dual conduit strings;

a pull tube latch having a portion thereof connected to the pull tube mandrel, said pull tube latch having another portion thereof connected to another portion of said other string of said dual conduit strings; and a release sleeve slidable within said upper housing, when in a first position in said upper housing, having a portion thereof abutting a portion of said lower housing to prevent said lower housing from disconnecting from said upper housing and having a portion thereof abutting said pull tube latch to prevent said pull tube from disconnecting from said pull tube mandrel and when in a second position in said upper housing, disengaging from contact with said lower housing and said pull tube latch.

5. The apparatus of claim 1 wherein the actuating tool means includes:

a housing;

a lower end plug having a portion thereof connected to a portion of the housing;

a match drill assembly having a portion thereof connected to the housing;

a setting mandrel having a portion thereof slidably, sealingly engaging a portion of the housing and releasably connected to the match drill assembly;

a bonded seal assembly slidably retained on a portion of the setting mandrel;

an upper element cone slidably, releasably retained on a portion of the setting mandrel;

a retrieving mandrel slidably, releasably connected to a portion of the setting mandrel; and an upper end plug having a portion thereof connected to a portion of the setting mandrel and having a portion thereof slidably engaging a portion of the retrieving mandrel.

6. A tubing release assembly installed in a dual conduit string in a well bore to connect and release when actuated one portion of said dual conduit string to and from another portion of said dual conduit string, said dual conduit string and said well bore having fluid therein, said tubing release assembly comprising:

a first member connected to one portion of said dual conduit string, the first member including an upper housing having a portion thereof connected to a portion of one conduit string of said dual conduit string;

a second member connected to another portion of said dual conduit string, the second member including an adjustment nut having a portion thereof connected to another portion of said one conduit string of said dual conduit string and a lower housing having a portion thereof releasably engaging a portion of the upper housing;

a pull tube mandrel having a portion thereof connected to one portion of the other conduit string of said dual conduit string;

a pull tube adapter having a portion thereof connected to the pull tube mandrel;

a pull tube latch having a portion thereof connected to the pull tube adapter and another portion thereof connected to another portion of the other conduit string of said dual conduit string; and a release member which is movable from a first position with respect to said first member and said second member having a portion thereof engaging said first member and said second member to cause said first member and said second member to engage to a second position with respect to said first member and said second member having a portion thereof remaining in engagement with said portion of said first memer and disengaging from said portion of said second member upon the communication of a fluid pressure to said tubing release assembly which is less than the hydrostatic pressure of either said fluid in said dual conduit string or said well bore at the location in said dual conduit string at which said tubing release assembly is installed in said dual conduit string to allow the release of the first member from the second member by the movement of said release member from said first position to said second position whereby said second member releases from engagement from said first member.

7. The tubing release assembly of claim 6 wherein the release member is a release sleeve slidably within the upper housing, when in a first position in the upper housing, having a portion thereof abutting a portion of the lower housing to prevent the lower housing from disconnecting from the upper housing and having a portion thereof abutting the pull tube latch to prevent the pull tube latch from disconnecting from the pull tube adapter and when in a second position in the upper housing, disengaging from contact with the lower housing and pull tube latch.

8. An actuating tool for use with a tubing release assembly installed in a conduit string installed, in turn, in a well bore, said conduit string and said well bore having fluid therein, said actuating tool comprising:

a member having a chamber therein capable of retaining a desired level of fluid pressure therein, the member having a chamber therein including:

a housing;

a lower end plug having a portion thereof connected to a portion of the housing;

a match drill assembly having a portion thereof connected to the housing;

a setting mandrel having a portion thereof slidably, sealingly engaging a portion of the housing and releasably connected to the match drill assembly;

an upper element cone slidably, releasably retained on a portion of the setting mandrel;

a retrieving mandrel slidably, releasably connected to a portion of the setting mandrel; and an upper end plug having a portion thereof connected to a portion of the setting mandrel and having a portion thereof slidably engaging a portion of the retrieving mandrel; and means to communicate the desired level of fluid pressure in the chamber of the member to said tubing release assembly to cause actuation thereof.

9. The actuating tool of claim 8 wherein the means to communicate the desired level of fluid pressure in the chamber of the member to the tubing release assembly to cause actuation thereof includes:

a bonded seal assembly slidably retained on a portion of the setting mandrel sealing engaging the setting mandrel and sealingly engaging said tubing release assembly the bonded seal assembly adapted to communicate with the chamber and said tubing release assembly.

10. A method of releasing a fluid filled tubing string in a fluid filled well bore comprising the steps of:

assembling a tubing release assembly in said tubing string;

running the tubing release assembly assembled into said tubing string into said well bore, said tubing string having said fluid therein said well bore having said fluid therein;

providing an actuating assembly capable of actuating the tubing release asssembly;

running the actuating assembly into said tubing string;

retaining within the actuating assembly as fluid pressure level which is less than either the hydrostatic pressure level of said fluid in said tubing string or the hydrostatic pressure level of said fluid in said well bore at the location in which the tubing release assembly is located in said tubing string in said well bore; and actuating the actuating assembly to cause the tubing release assembly to release a portion of said tubing string form another portion of said tubing string by communicating the pressure level retained within the actuating assembly to the tubing release assembly.

11. The method of claim 10 wherein the method further comprises the step of:

providing a dual tubing string for said tubing string.

12. The method of claim 10 wherein the method further comprises the step of:

engaging a portion of the tubing release assembly with the actuating assembly to communicate the pressure level retained by the actuating assembly to the tubing release to actuate the tubing release assembly.

* * * * *

UNITED STATES PATENT AND TRADEMARK OFFICE

CERTIFICATE OF CORRECTION

PATENT NO. : 4,760,884

DATED : August 2, 1988

INVENTOR(S) : David M. Haugen et al.

It is certified that error appears in the above-identified patent and that said Letters Patent is hereby corrected as shown below:

In column 14, line 62, delete the word [form] and insert therefor --from--.

Signed and Sealed this

Seventeenth Day of January, 1989

*Attest:*

DONALD J. QUIGG

*Attesting Officer*

*Commissioner of Patents and Trademarks*